United States Patent [19]

Buehning

[11] Patent Number: 4,986,743

[45] Date of Patent: Jan. 22, 1991

[54] MELT BLOWING DIE

[75] Inventor: Peter G. Buehning, Short Hills, N.J.

[73] Assignee: Accurate Products Co., Hillside, N.J.

[21] Appl. No.: 322,562

[22] Filed: Mar. 13, 1989

[51] Int. Cl.[5] ..... B29C 47/30; D01D 5/08

[52] U.S. Cl. ..... 425/7; 425/72.2; 425/192 S; 425/464

[58] Field of Search ..... 425/192 S, 7, 191 S, 425/72.2, 72.1, 141, 191, 192, 190, 463, 466, 465, 464, 131.5, DIG. 217; 264/12

[56] References Cited

U.S. PATENT DOCUMENTS 3,460,199 8/1969 Hecksotte et al. ..... 425/191 S 4,464,104 8/1984 Gneuss ..... 425/141

4,465,652 8/1984 Lentz ..... 425/192 R 4,486,161 12/1984 Middleton ..... 425/7

FOREIGN PATENT DOCUMENTS

WO87/04195 7/1987 PCT Int'l Appl. .

*Primary Examiner*—Jay H. Woo

*Assistant Examiner*—Khanh P. Nguyen

*Attorney, Agent, or Firm*—R. L. Graham

[57] ABSTRACT

A die tip of a meltblowing die is mounted on the die body to provide a residual compressive force in the die tip nosepiece thereby resisting internal extrusion pressures.

9 Claims, 2 Drawing Sheets

MELT BLOWING DIE

FIELD OF THE INVENTION

This invention relates to the melt blowing of thermoplastic fibers, and more particularly to an improved melt blowing die.

BACKGROUND OF THE INVENTION

Melt blowing is a process for manufacturing nonwoven products by extruding molten thermoplastic resin through fine capillary holes (orifices) and blowing hot air on each side of the extruded fibers to attenuate and draw down the fibers. The fibers are collected on a screen or other suitable collection device as a random entangled nonwoven web. The web may be withdrawn and further processed into consumer goods such as mats, fabrics, webbing, filters, battery separators, and the like.

Because of the extreme precision required in machining the orifices and flow passages, a key portion of the die, frequently referred to as the die tip, is separately manufactured using high quality steel. The die tip is then assembled into the die body.

The die tip is an elongate member having a nose piece of triangular cross section. The orifices are drilled in the tip of the triangular apex and communicate with an internal flow channel formed in the die tip.

A serious problem associated with die tips of this construction is the reduced mechanical strength in the apex region of the die tip. The orifices, in combination with the internal flow channel, creates a weakness in the apex region of the structure because of the reduced cross sectional area of steel in this region. The high internal pressures caused by extruding the molten resin through the tiny orifices frequently causes the nosepiece to fail in tension at the apex. This problem was identified in U.S. Pat. No. 4,486,161 which teaches the use of integral tie bars spanning the die tip flow channel. This reference also discloses (FIG. 2) the use of bolts and spacers across the flow channel.

SUMMARY OF THE INVENTION

The present invention reduces the tendency of the nosepiece to fail by providing a construction which results in residual compressive forces and stresses in the apex region of the nosepiece when assembled. The residual stresses counteract the internal fluid pressure so that the net forces tending to split the apex region are reduced or eliminated.

The die tip is adapted to be mounted on a surface formed in the die body and bolted in place. Internal shoulders formed on opposite edge portions of the mounting surface engage opposite longitudinal edge portions of the die tip with the bottom of the die spaced slightly from the confronting mounting surface. Upon bolting the die tip to the die body, opposite and equal bending moments about the shoulders (acting as fulcrums) are created. These bending moments oppose each other in the nosepiece apex region resulting in compressive stress in that region. Thus, upon pressurizing the die tip flow channel, the internal fluid pressures are counteracted by the compressive forces in the apex region. This reduces the tensile forces imposed in the apex region.

The die tip, or a component thereof, must contact the die body to provide a fluid seal for molten polymer to flow from die body passages to the die tip flow channel.

The shoulders must be sized in relation to the contacting seal surfaces of the die tip and the mounting surface to provide sufficient fluid seal contact and yet retain the residual compressive forces in the apex region.

Other mounting configurations are possible for achieving compressive stress in the apex region. The principle involved in the present invention relies on creating opposite and equal bending moments about the longitudinal edge portions of the die tip which are at least in part resisted by opposite and equal forces imposed at the apex region.

Applicant's copending application, U.S. Ser. No. 130,359, filed Nov. 5, 1987, discloses a melt blowing die but does not disclose the novel feature of the present invention. U.S. Ser. No. 130,359 is based on PCT application No. PCT/US 86/00041, first published July 16, 1987 as International Publication No. WO 87/04195. It is important to note that the published PCT application does not disclose a die tip having compressive forces imposed in the apex region thereof. In fact, the structure disclosed in FIGS. 2 and 3 of the published PCT application would impose opposite bending moments thereby resulting in tensile stresses in the apex region which could, weaken the nosepiece.

DESCRIPTION OF THE PREFERRED EMBODIMENTS

Figure 1:
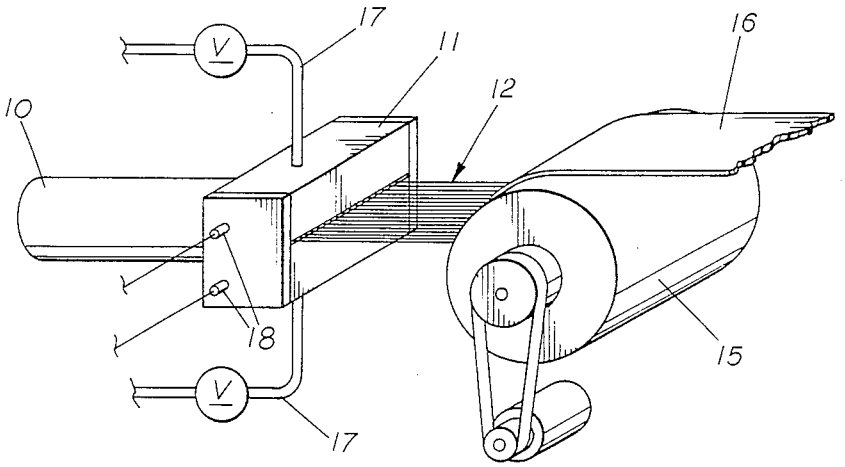
FIG. 1 is a schematic illustrating the main components of a melt blowing line.

A melt blown line is illustrated in FIG. 1 as comprising an extruder 10, melt blowing die 11 and a rotating collector drum or screen 15. Extruder 10 delivers molten resin to the die 11 which extrudes side-by-side fibers into converging hot air streams. The air streams attenuate and draw the fibers down forming air/fiber stream 12. The fibers are collected on screen 15 and are withdrawn as a web 16. The typical melt blowing line will also include an air source connected to the die 11 through valved lines 17 and heating elements 18.

Figure 3:
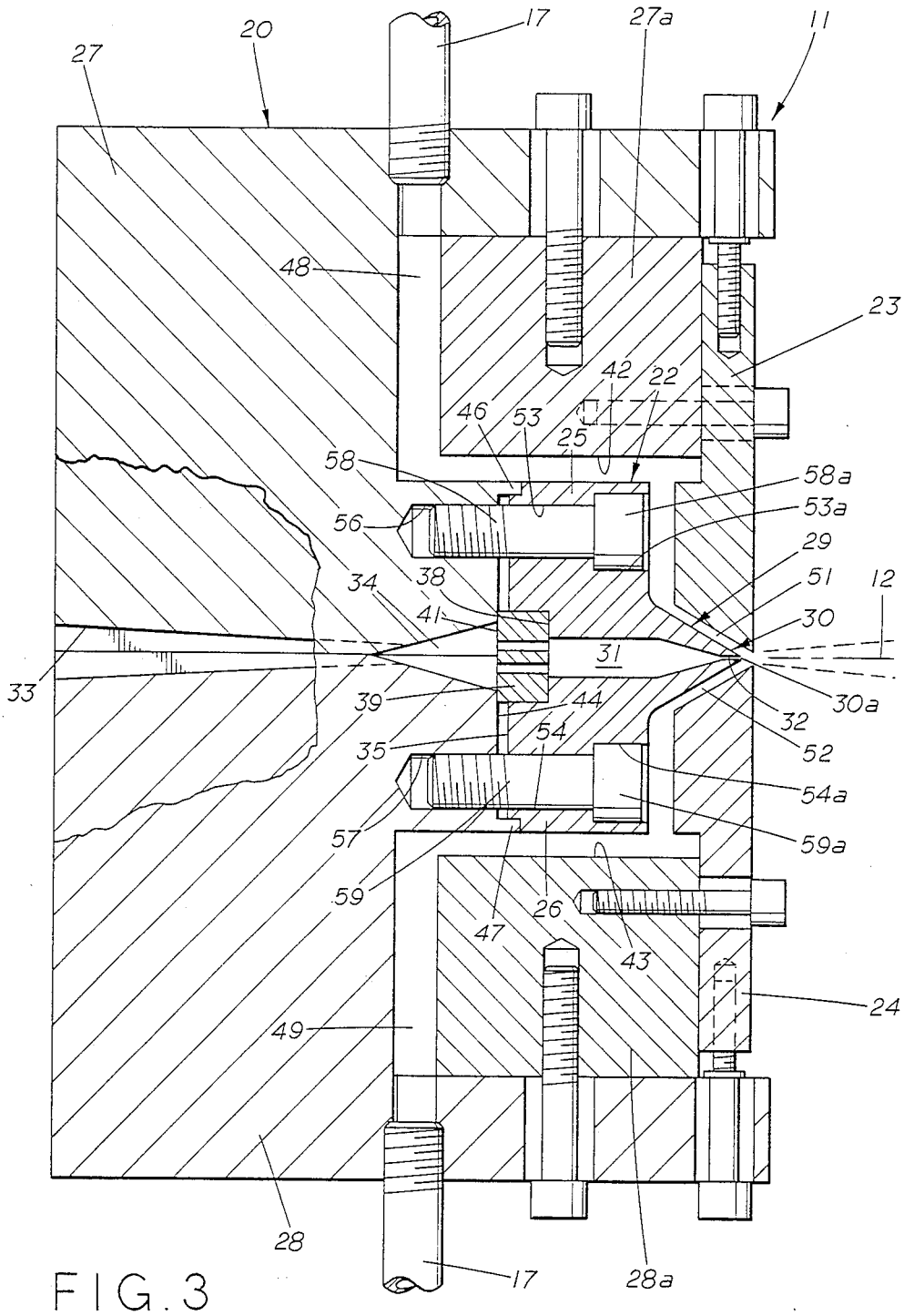
FIG. 3 is a cross-sectional view of a meltblowing die illustrating the die tip of FIG. 2 mounted on the die body.

As shown in FIG. 3, the die 11 includes body 20, an elongate die tip 22 secured to the die body 20, and air plates 23 and 24. For purposes of this invention, the die body 20 is constructed in die halves 27 and 28 (including parts **27*a* and 28*a*) which, when assembled, form the die body 20**. Details of the die body assemblage are not illustrated. However, the assemblage of these parts may be by bolts as disclosed in copending application USSN No. 130,359.

Figure 2:
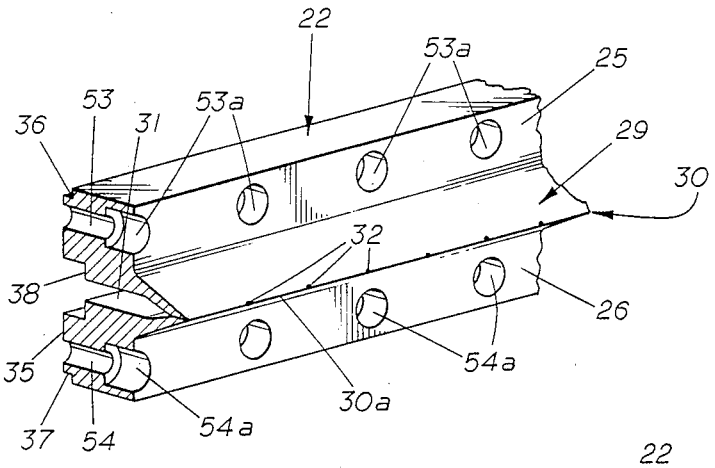
FIG. 2 is a perspective view of a die tip constructed according to the present invention.

As best seen in FIG. 2, the die tip 22 includes outwardly extending nose piece 29 of triangular cross section and flanking flanges 25 and 26. The nose piece 29 terminates in apex region 30. The included angle of the taper of the nose piece 29 generally ranges from 45 to 90 degrees. A central elongate channel 31 is formed in the die tip 22. A plurality of side-by-side orifices 32 are drilled in the apex region 30 and are in fluid communication with channel 31. The apex region 30 of the nosepiece 29 is the tip portion which contains the orifices 32. The orifices are distributed along knife edge apex 30*a* of the nosepiece 29, with from 10 to 40 orifices per inch being generally provided. The orifices 32 are generally 0.010 to 0.025 inches in diameter.

The interior side of the die tip 22 includes flat surface 35 and longitudinal notches 36 and 37 (see FIG. 2) flanking surface 35. For purposes of defining the spacial relationship of die tip parts to the die body, the term "interior" refers to die tip parts adjacent the die body. A longitudinal groove 38 is formed in a central portion of die body surface 35 and at the inlet of channel 31. As shown in FIG. 3, generally flat flow distribution member 39 (referred to as a breaker plate) is mounted in groove 38. The internal part of the breaker plate 39 is perforated to permit passage of molten resin when mounted in groove 38. The breaker plate 39 protrudes slightly beyond surface 35 and is provided with flat surface 41. The longitudinal outer edge portions of surface 41 of the breaker plate 39 engage the die body and as described below forms a fluid seal therewith. For purposes of this invention, the breaker plate 39 is considered to be a part of the die tip 22. In some die constructions, however, it may not be necessary to provide a breaker plate 39. In such constructions, the groove 38 would not be needed and embossed strips (illustrated in FIG. 4) flanking the channel 31 and protruding outwardly from surface 35 could serve as the seal surface on the body 20.

The die body 20, which is generally fabricated from high quality steel in symmetrical halves and bolted together, has formed therein a groove defined by sidewalls 42 and 43 and bottom surface 44. Also formed at longitudinal edge portions of the surface 44 are parallel shoulders 46 and 47 which are sized to mate with parallel notches 36 and 37 of the die tip 22. Shoulders 46 and 47 provide the mounting support means for the die tip 22. Note that the shoulders 46 and 47, in addition to supporting edge portions of the die tip, in the direction of bolt force (described below), also prevent lateral expansion or movement of the die tip base.

A coat hanger flow passage 33 terminates in cavity 34 in a central portion of surface 44. Cavity 34 extends substantially the full length of the die and serves to distribute molten polymer therealong and deliver polymer to channel 31 through breaker plate 39.

The die body 20 also includes air conduits 48 and 49 for delivering air to opposite sides of the die tip 22. The air plates 23 and 24 in combination with the die tip 22 define converging air flow passages 51 and 52. Converging air streams discharge at the knife edge 30 *a* of the nosepiece 29 and contact fibers of molten resin extruded from orifices 32. The air streams attenuate and draw the fibers down forming air/fiber streams illustrated by reference numeral 12 in FIGS. 1 and 3.

As best seen in FIG. 2, the die tip flanges 25 and 26 are each provided with a set of aligned bolt holes 53 and 54. Bolt holes 53 and 54 are, respectively, aligned on opposite sides of nose piece 29 and the outer ends of each are counterbored at 53*a* and 54*a*.

Returning to FIG. 3, the die tip 22 fits in die body 20 with the shoulders 46 and 47 receiving the complementary shaped die notches 36 and 37.

The die body 20 has formed therein two sets of aligned threaded bolt holes 56 and 57 which open to and are spaced along surface 44. The bolt holes 56 and 57 are aligned, respectively, with die tip holes 53 and 54. Bolts 58 and 59 extend through holes 53 and 54 of die tip 22 and are threaded to holes 56 and 57 thereby securing the die tip 22 to body 20. The bolt heads 58*a* and 59*a* fit in counterbores 53*a* and 54*a*.

With the breaker plate 39 mounted in groove 38, die tip 22 is positioned on shoulders 46 and 47 of the die body 20. The bottom surface 41 of breaker plate 39 confronts a portion of surface 44 surrounding cavity 34. With the die tip 22 positioned on the shoulders 46 and 47, but not bolted, the die tip surface 35 is spaced from die body surface 44 and breaker plate surface 41 is spaced from die body surface 44. The unstressed spacing ($S_1$) between surfaces 35 and 44 is greater than the unstressed spacing ($S_2$) between surfaces 41 and 44. In order to provide the fluid seal for polymer flowing from cavity 34 to channel 31, $S_2$ is 0 in the bolted position of die tip 22. The following are the preferred spacing $S_1$ and $S_2$:

| Die Tip Positioned But Not Bolted | Die Tip Bolted |
|---|---|
| $S_1$ from 0.005 to 0.030 mils | from 0.004 to 0.029 mls (avg.) |
| $S_2$ from 0.001 to 0.010 mils | 0 |
| $S_1 > S_2$ | |

From the above, it is apparent that $S_2$ (not bolted) equals $S_1$ (not bolted) minus $S_1$(bolted).

It should be noted that the spacing between surfaces 41 and 44 are measured with the breaker plate 39 fully mounted in groove 38. In practice, the plate 39 may engage surface 41 leaving the space between the inner surface of plate 39 and the bottom of groove 38. As will be appreciated from the following description, the spacing may be at either location.

Upon tightening of bolts 58 and 59, opposite bending moments are imparted on the die tip 22 about shoulders 46 and 47, which act as fulcrums. Bolts 58 create a bending moment in the clockwise direction as viewed in FIG. 3 and bolts 59 create a counterclockwise bending moment. These bending forces, being in opposite directions, concentrate in the apex region 30 of the die tip 29. Continued torquing of bolts 58 and 59 causes the surface 41 to sealingly contact surface 44 providing a fluid seal for polymer flow from cavity 34 to channel 31. Note that the bolting force causes plate 39 to fully seat in groove 38 (regardless of its starting position) and form a seal therewith.

Figure 4:
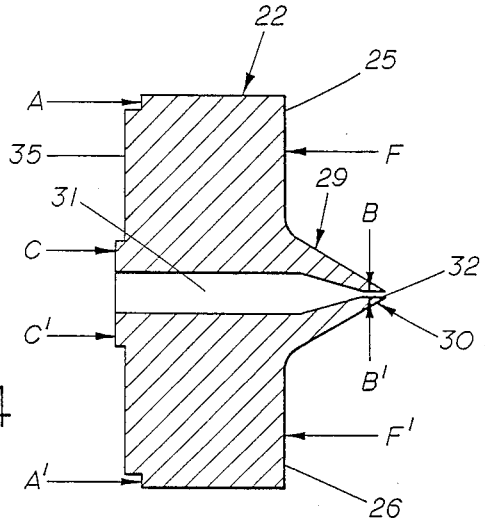
FIG. 4 is a force diagram of the die tip as mounted on the die body illustrating the bending moments imposed on the die tip.

The force diagram of FIG. 4 depicts the mounting forces imposed on the die tip 22. The bending moments created by bolt Forces F, F′ about fulcrums A,A′ create opposite and equal forces B, B′ in the apex region 30 and forces C,C′ in the fluid seal regions. At least a portion of the forces B, B′ are created prior to creation of forces C,C′. The opposite and equal forces B and B′ create compressive forces which are maintained with the die tip 22 bolted to body 20. These compressive forces counteract fluid pressure forces within channel 31. Although the forces B and B′ may vary within wide ranges, depending on several factors, they should be sufficient to create compressive stress of at least 1,000 psi, preferably at least 10,000 psi, and most preferably at least 20,000 psi in the apex region 30 (i.e. the area of metal in a plane passing through the axes of the orifices 32). The greater $S_2$, the greater the compressive stress. $S_2$ of 0.002 to 0.005 are preferred.

An important feature of the die constructed according to the present invention is the means for mounting the die tip 22 on the die body which creates compressive forces in the apex region 30. This is achieved by supporting edge portions of the die tip 22 on the die body so that opposite and equal bending moments are imposed on the nose piece 29. When the bolts 58 and 59 are fully torqued a residual compressive stress is created in the apex region 30 and a compressive seal force is created at the junction of surfaces 41 and 44. Other structures for creating the bending moments are possible. For example edge projections in the die tip (in place of the notches 36 and 37) could engage surface 44 (without shoulders 46 and 47) thereby providing $S_1 > S_2$. In other constructions, it is possible to create the residual compressive forces in the apex region where $S_1 = S_2$ (unstressed).

With the die tip 22 bolted to the die body, molten polymer flows through passages 33, 34, plate 39, channel 31, and orifices 32, while hot air flows through air passage 48, 51, and passage 49 and 52, discharging as sheets on opposite sides of the nosepiece apex 30*a*. As described above, the internal pressure in the apex region 30 is counteracted in part by the compressive forces imparted by the opposite bending moments concentrated on that region.

Although the present invention has been described with reference to the preferred embodiment, it will be appreciated that variations are possible without departing from the inventive concept described and claimed herein.

What is claimed is:

1. A meltblowing die comprising:

(a) enlongate die tip having an outwardly extending triangular nose piece terminating in an apex region, an internal molten polymer flow channel, and a plurality of orifices formed in the apex region and being in fluid communication with the flow channel and being arranged in side-by-side relation forming a row;

(b) a die body having air flow passages formed therein for delivering air to opposite sides of the nose piece, and polymer flow cavity for delivering molten polymer to the flow channel in the die tip; and (c) mounting means for securing said die tip on the die body and for applying equal forces on opposite sides of the row of orifices in the apex region of the triangular nose piece, said forces acting in a direction on the nose piece inwardly toward said orifices thereby maintaining the apex region in compression.

2. The die as defined in claim 1 wherein the means for mounting the die tip on the die body includes an elongate interior surface formed on the die tip; an outwardly facing surface formed on the die body and adapted to receive said die tip interior surface, said die body surface contacting the die tip surface at its outer elongate edges and at inner portions surrounding the junction of the polymer cavity and the die tip flow channel, the die tip surface and die body surface being spaced apart in regions between the contact surfaces; a first set of bolts spaced along the die tip on one side of the nose piece traversing the space between the die tip and die body surfaces; and a second set of bolts spaced along the die tip on the opposite side of the nose piece and traversing the space between the die tip and die body surfaces; said first and second sets of bolts being threaded to the die body whereby opposite and equal bending moments are created, said bending moments concentrating and creating compressive forces at the apex region of the nose piece.

3. A meltblowing die which comprises (a) a die body having formed therein
  (i) an elongate die tip mounting surface
  (ii) a polymer flow passage terminating in an elongate outlet cavity opening into a central portion of the mounting surface, and
  (iii) a seal surface formed in the mounting surface and surrounding the cavity;

(b) an elongate die tip adapted to be mounted on the mounting surface of the die body and having
  (i) an outwardly extending triangular nose piece terminating in an apex region,
  (ii) an internal flow channel having an inlet opposite the apex region,
  (iii) a plurality of orifices formed in the apex region and being in fluid communication with the flow channel, and
  (iv) a seal surface surrounding the inlet of the flow channel, said seal surface being aligned with the seal surface formed on the die body mounting surface;

(c) means formed on the die body mounting surface for supporting opposite longitudinal edge portions of said die tip, the die tip between the supported edge portions being spaced from the die body mounting surface with no mounting forces applied; and (d) means for forcefully mounting the die tip on the die body mounting surface to impart opposite and equal bending moments about the support means thereby creating a compressive force in the apex region of the nose piece and creating a fluid seal contact between the seal surfaces of the die tip and the die body mounting surface.

4. A meltblowing die which comprises (a) a die body having formed therein
  (i) an elongate groove having a bottom surface
  (ii) a polymer flow passage having an outlet cavity in a central portion of the groove bottom surface,
  (iii) a shoulder at each longitudinal edge of the groove bottom, and
  (iv) a seal surface formed in the groove bottom surface surrounding the outlet cavity;

(b) a die tip mounted in the die body groove and having
  (i) an outwardly extending triangular nose piece terminating in an apex region,
  (ii) an internal elongate flow channel,
  (iii) a plurality of orifices formed in and spaced along, the apex region and being in fluid communication with the flow channel,
  (iv) a pair of parallel and elongate notches formed in the interior longitudinal edges of the die tip and being supported on the die body shoulders, and
  (v) a protruding surface surrounding the flow channel inlet and contacting the seal surface of the die body, said flow channel being in fluid communication with the die body polymer flow cavity; and (c) a plurality of bolts extending through the die tip on both sides of the triangular nosepiece and threadedly connected to the die body between the die body shoulders and the seal surfaces, the shoulders and die tip notches being sized such that with the die tip bolted to the die body, the apex region of the nose piece is in compression with no internal pressure in the flow channel and the seal surface of the die tip sealingly contacting the seal surface of the die body.

5. The die as defined in claim 4 wherein the die tip further has an elongate groove formed therein at the inlet of the flow channel and a flow distribution member mounted in said die tip groove said member having a surface facing outwardly from the die tip and defining the seal surface of the die tip.

6. The die as defined in claim 5 wherein only the longitudinal edges and the seal surface of the die tip contact the die body.

7. The die as defined in claim 4 wherein compressive stress in the apex region is at least 10,000 psi.

8. A meltblowing die which comprises (a) a die body having formed therein (i) an elongate flat bottom groove;

(ii) a molten polymer flow passage having an elongate outlet cavity in a central portion of the groove bottom; and (iii) seal surface means formed in the groove bottom and surrounding the flow passage cavity, (b) a die tip mounted in the die body groove and having (i) an outwardly extending triangular nose piece terminating in an apex region, (ii) an internal flow channel;

(iii) a plurality of orifices formed in the apex region and being in fluid communication with the flow channel; and (iv) a seal surface surrounding the flow channel inlet and adapted to contact the seal surface of said die body, said seal surfaces being spaced apart with no mounting force applied to the die tip;

(c) means formed in said groove or on said die tip for supporting longitudinal interior edges of the die tip with confronting surfaces of the die tip and the groove bottom between the edges being spaced apart with no mounting force applied to the die tip; and (d) a plurality of bolts extending though the die tip on both sides of the triangular nosepiece and threadedly connected to the die body, said bolts extending from the die tip across the spaced apart confronting surfaces, and being tightened sufficiently to impart compressive forces in the apex region and to cause the seal surfaces to sealingly contact one another.

9. The die as defined in claim 8 wherein the die tip has an elongate groove formed therein at the inlet of the flow channel and a flow distribution member mounted therein, said flow distribution member defining the a seal surface of the die tip.

* * * * *